US006512438B1

(12) United States Patent
Yoshimori et al.

(10) Patent No.: US 6,512,438 B1
(45) Date of Patent: Jan. 28, 2003

(54) INDUCTOR CORE-COIL ASSEMBLY AND MANUFACTURING THEREOF

(75) Inventors: Hitoshi Yoshimori, Yamatokoriyama (JP); Ryusuke Hasegawa, Morristown, NJ (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

(21) Appl. No.: 09/464,982

(22) Filed: Dec. 16, 1999

(51) Int. Cl.[7] ..... H01F 17/06
(52) U.S. Cl. ..... 336/178; 336/229; 336/96
(58) Field of Search ..... 336/229, 96, 178

(56) References Cited

U.S. PATENT DOCUMENTS

| | | | | |
|---|---|---|---|---|
| 2,777,116 A | | 1/1957 | Gordon | |
| 4,603,314 A | * | 7/1986 | Fukunaga et al. | 336/65 |
| 4,652,771 A | * | 3/1987 | Specht et al. | 307/83 |
| 5,122,947 A | * | 6/1992 | Hishiki | 363/61 |
| 5,165,162 A | * | 11/1992 | Charles | 29/605 |
| 5,378,966 A | * | 1/1995 | Marszalik | 315/411 |
| 5,748,013 A | * | 5/1998 | Beauclair et al. | 336/233 |
| 5,828,282 A | * | 10/1998 | Tiemann | 336/84 R |
| 6,144,279 A | * | 11/2000 | Collins et al. | 336/178 |

FOREIGN PATENT DOCUMENTS

| | | | | |
|---|---|---|---|---|
| JP | 3-265109 | * | 11/1991 | 336/229 |
| JP | 6-5437 | * | 1/1994 | 336/229 |
| JP | 07 263261 A | | 10/1995 | |
| WO | WO 97 06540 A | | 2/1997 | |

OTHER PUBLICATIONS

Patent Abstracts of Japan vol. 1996, No. 02, Feb. 29, 1996.
Copy of International Search Report of PCT/US00/3334 filed Dec. 8, 2000, dated Feb. 15, 2001.

* cited by examiner

*Primary Examiner*—Anh Mai
(74) *Attorney, Agent, or Firm*—Roger H. Criss

(57) ABSTRACT

Disclosed are a gapped magnetic core which may be coated or uncoated with an insulating layer or housed in an insulting box having a physical gap whose dimension is close to that of the gapped magnetic core and automated or semi-automated methods of applying copper wire on the gapped core or the core assembly and filling the gap with a spacer in the core or core assembly. The disclosed processes allow various combinations of core and spacer materials and gap configurations, resulting in a wide variety of core-coil assemblies which are useful as inductive components in electric and electronic circuits. Also disclosed is a core-coil assembly wherein a magnetic core with a gap directed off the conventional radial direction of a toroidally-wound core.

8 Claims, 13 Drawing Sheets

INDUCTOR CORE-COIL ASSEMBLY AND MANUFACTURING THEREOF

FIELD OF INVENTION

This invention relates to inductor core-coil assembly for use as magnetic components in electric and electronic circuits such as converters, inverters, noise filters, resonant circuits, and the like.

BACKGROUND OF INVENTION

Currently two types of magnetic cores are widely used in the inductive components in electric and electronic circuits such as AC-to-DC and DC-to-DC converters, inverters, filters for electronic noises, electronic resonant circuits and the like. One kind is a toroidally-shaped core with no physical gap and the other has at least one gap. In both cases, copper winding(s) must be applied on the core to form a magnetic inductor. When the required copper wire size is thin, the copper winding can be automated and equipment for such operation is available. However, due to the nature of this operation, such equipment requires a wire handling mechanism akin to that of a sewing machine which uses flexible threads. When the wire size is thick, such automated process becomes difficult and manual copper winding is a standard practice. It is therefore desirable to simplify the existing copper winding mechanism which enables to improve the winding productivity in general and eliminate the manual winding operation for the components requiring thick-gauge wires.

SUMMARY OF INVENTION

In accordance with the invention, there is provided a core-coil assembly and manufacturing thereof. A magnetic core has at least one physical gap and an insulated core assembly is formed by coating the gapped magnetic core with an electrical insulator or covering it with an insulating box having a physical gap whose dimension is close to that of the magnetic core gap. A copper wire passes through the gap of the core or the core assembly to be wound on the core or the core assembly. The copper-wire winding is also performed by rotating the core or the core assembly around the tangential direction of the circumference of the core or the core assembly. To improve magnetic performance of a gapped core, a non-conventional gap is introduced whose direction is off the radial direction of a toroidally wound core. The magnetically improved core with a non-conventional gap can be housed in a conventional core box with no gap and a copper winding may be applied on it to use it as in inductor. The copper winding part, on the other hand, can be prefabricated separately and a gapped core or core assembly is then inserted into the prefabricated coil through the gap. The gap section of the core or the core assembly may be filled with a magnetic or non-magnetic spacer during or after coil-winding operation. The core-coil assembling method of the present invention is much simpler than the existing method and thus is fully or semi-automated, improving core-coil assembly production yield with consistent performance.

The core-coil assembly manufactured in accordance with the method of the present invention is especially suited for use in such devices as power converters, inverters, electrical noise filters, electrical resonators, and the like.

BRIEF DESCRIPTION OF THE DRAWING

The invention will be more fully understood and further advantages will become apparent when reference is made to the following detailed description of the invention and the accompanying drawings.

DETAILED DESCRIPTION OF THE INVENTION

Figure 1:
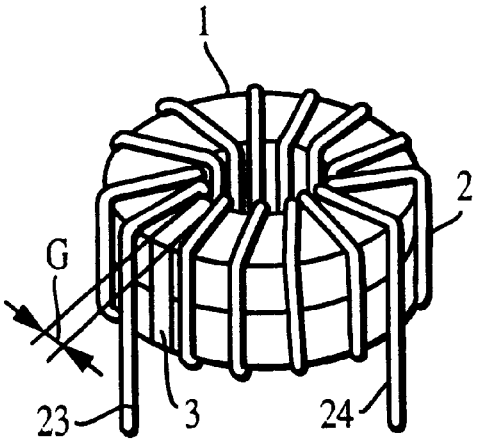
FIG. 1 depicts one of the core-coil assemblies of the present invention.
Figure 2:
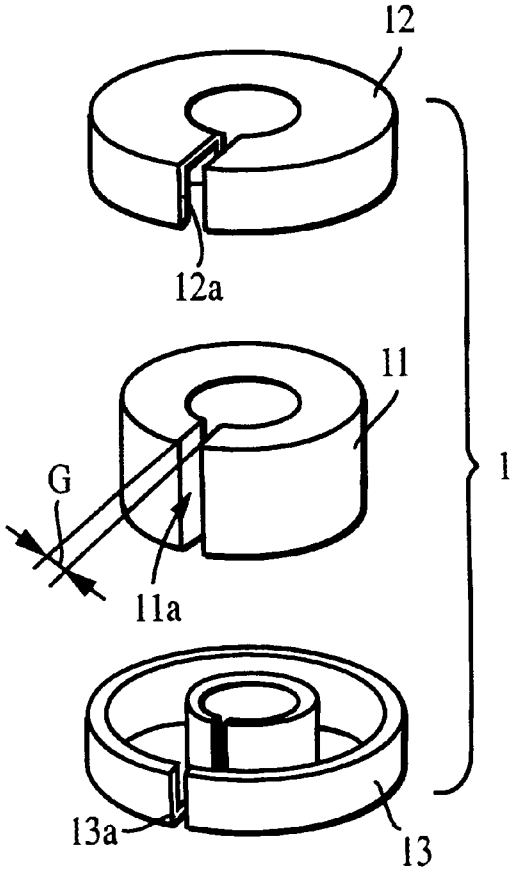
FIG. 2 shows a core assembly configuration of the core-coil assembly of FIG. 1.
Figure 3A:
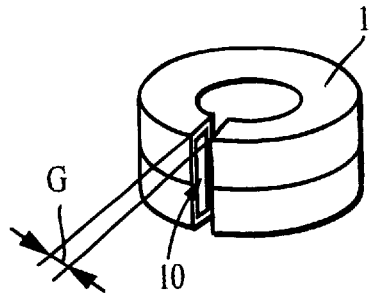
FIG. 3 shows a copper winding process of the present invention where a core assembly is relatively stationary.
Figure 3B:
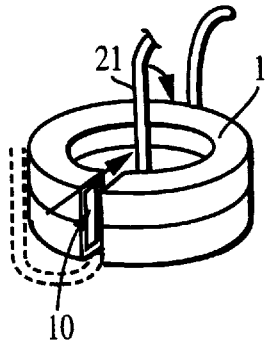
Figure 3C:
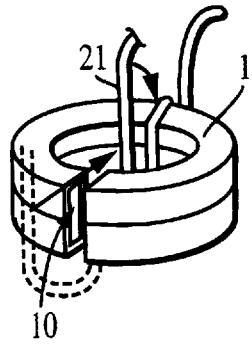
Figure 3D:
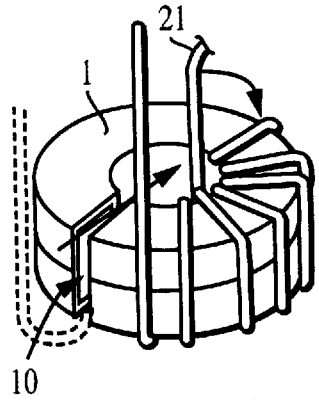

A simpler manufacturing method for magnetic core-coil assembly improves its performance as well as its production capability through automated processes. FIG. 1 represents a core-coil assembly of the present invention. The core 1 is composed of a magnetic core 11 with a gap 11*a* of width or size G and a two-part insulating boxes 12 and 13 with gaps 12*a* and 13*a*, respectively as shown in FIG. 2. Steps shown in FIGS. 3*a*–3*d* explain the sequence of coil winding on the core assembly 1. A copper wire 21 is first inserted, as shown in FIG. 3*b*, through gap 10 of core assembly 1 of FIG. 3*a*. After the first winding, successive windings are performed by moving the wire through gap 10 as indicated in FIGS.

Figure 4A:
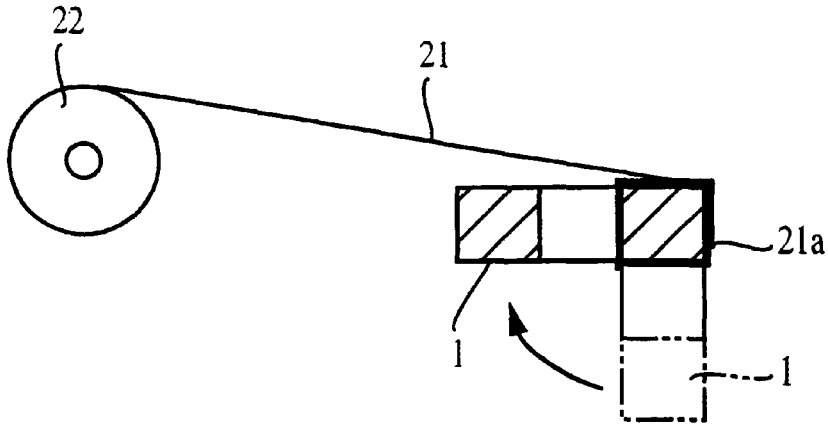
FIG. 4 shows a copper winding process of the present invention where a core assembly is rotated.
Figure 4B:
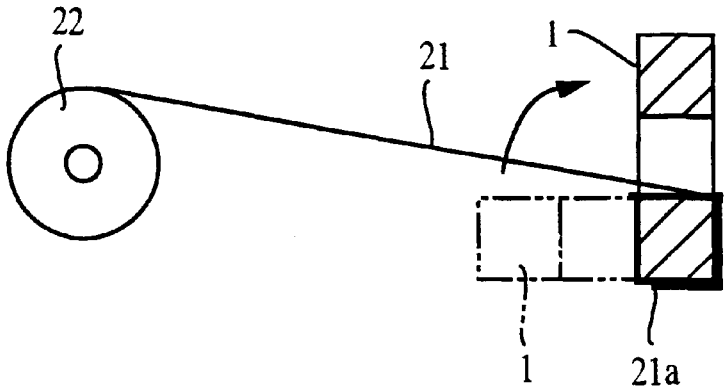
Figure 4C:
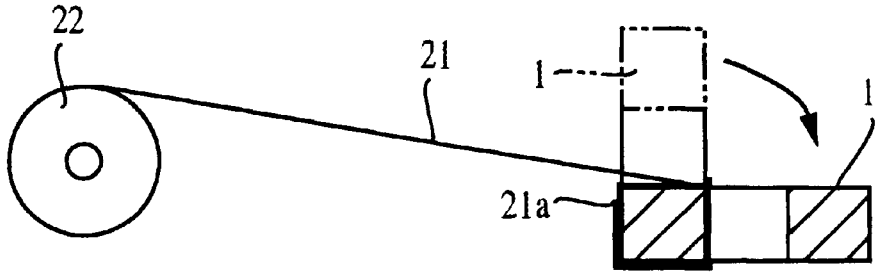
Figure 4D:
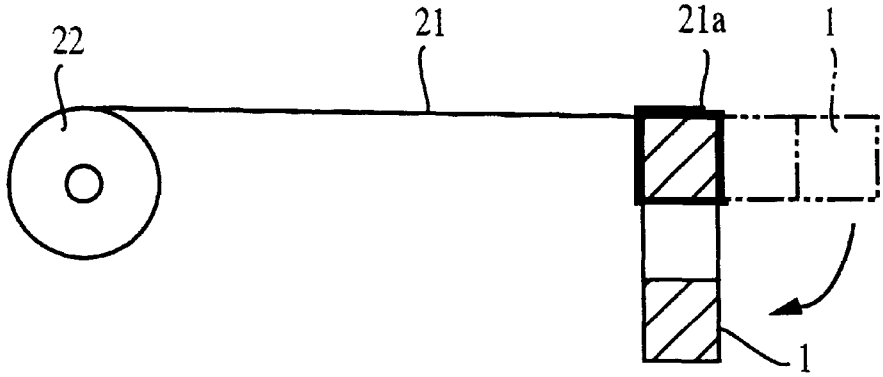

3*c*–3*d* until a predetermined number of turns is completely wound. The above operation results in a basic core-coil assembly of FIG. 1 of the present invention. The core-coil assembling is also performed by a method shown in FIG. 4, in which item 21 is the copper wire and item 22 is a spool of wire. This process begins with attaching one end 21*a* of copper wire 21 to a point on a core assembly as shown in FIG. 4*a*. Coil winding is accomplished by rotating the core assembly around the tangential direction of the core's circumference. Thus the wire spool 22 needs not to be rotated. This operation results in the core-coil assembly of FIG. 1.

In the process described above, when the magnetic core is coated with an insulating layer or when the copper wire is adequately coated with an insulating layer, insulating boxes 12 and 13 of FIG. 2 may not be needed. Both of the processes corresponding to FIGS. 3 and 4 are much simpler than the existing coil-winding process based on a sewing machine mechanism and are easily automated.

Figure 5A:
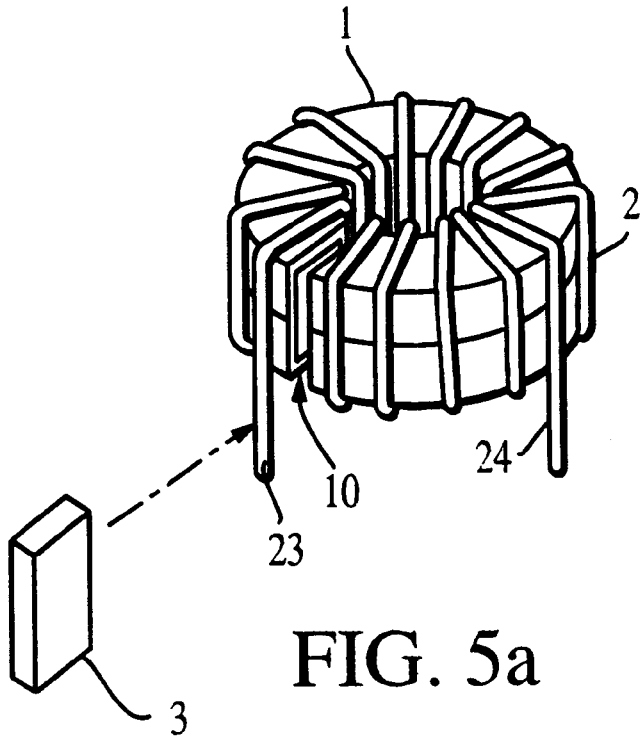
FIG. 5 indicates a process of inserting a magnetic or non-magnetic spacer.
Figure 5B:
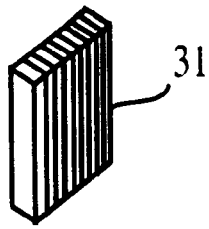
Figure 5C:
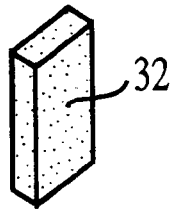
Figure 6:
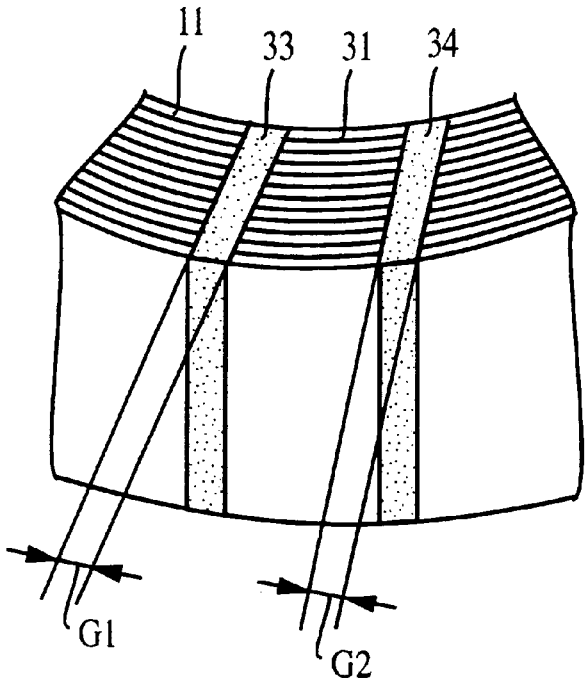
FIG. 6 depicts the case where the spacer is composed of a magnetic material and an insulator.

When a spacer 3 is need in the gap section 10, it may be inserted during or after coil winding as shown in FIG. 5. In this figure, spacer 3 is a non-magnetic material or an electrically conductive material, in which case an insulating layer may be applied on the surface of the spacer. The spacer 3 may be a laminated magnetic material 31 shown in FIG. 5*b* or a magnetic powder-based material 32 shown in FIG. 5*c*. In these cases, the effective air gap is G1+G2 as indicated in FIG. 6, in which only the case with spacer 31 is shown with item 33 and 34 being non-magnetic adhesives. After insertion of a spacer, a final core-coil assembly of FIG. 1 is now accomplished.

Figure 7:
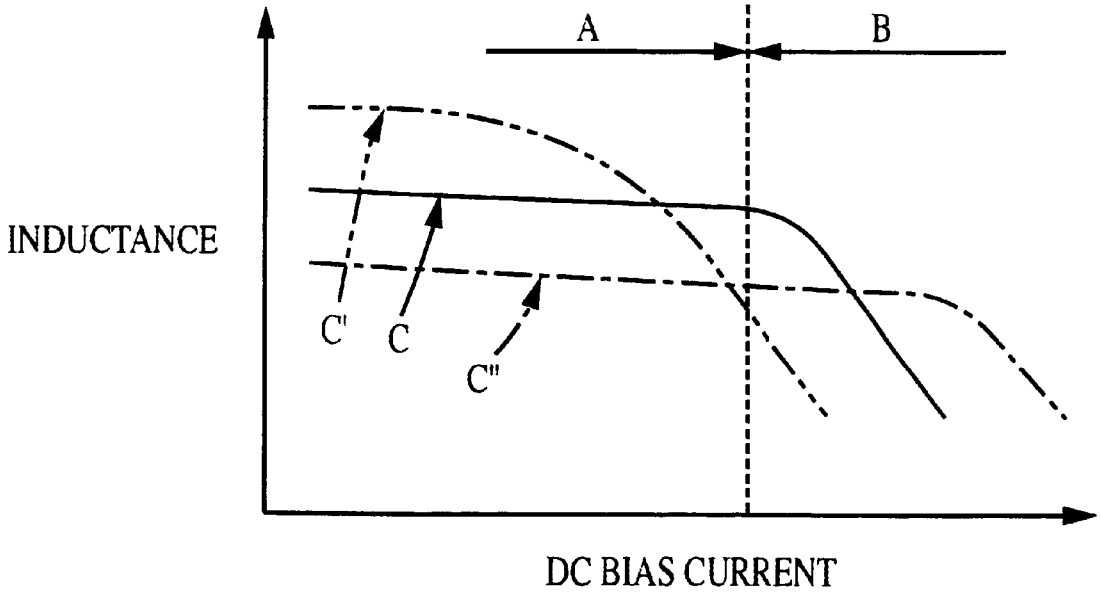
FIG. 7 is a schematic description of the inductance versus DC bias current for different core-coil configurations.

FIG. 7 compares the DC bias characteristics for the inductance of a core-coil assembly of the present invention. Region A and B correspond, respectively, to "active" and "inactive" DC bias region, when a control core-coil assembly is used as a choke coil exhibiting an inductance versus DC bias current characteristic corresponding to curve C. Here the terms "active" and "inactive" mean that the choke coil is functioning as an effective and ineffective inductor, respectively. If the gap G is reduced and or the number of copper winding is increased in FIG. 1 with respect to the control core-coil assembly, the inductance versus DC bias current curve shifts to the one indicated by C'. If the gap G is increased and/or the number of copper winding turns is decreased with respect to the control core-coil assembly, curve C" results.

Figure 8:
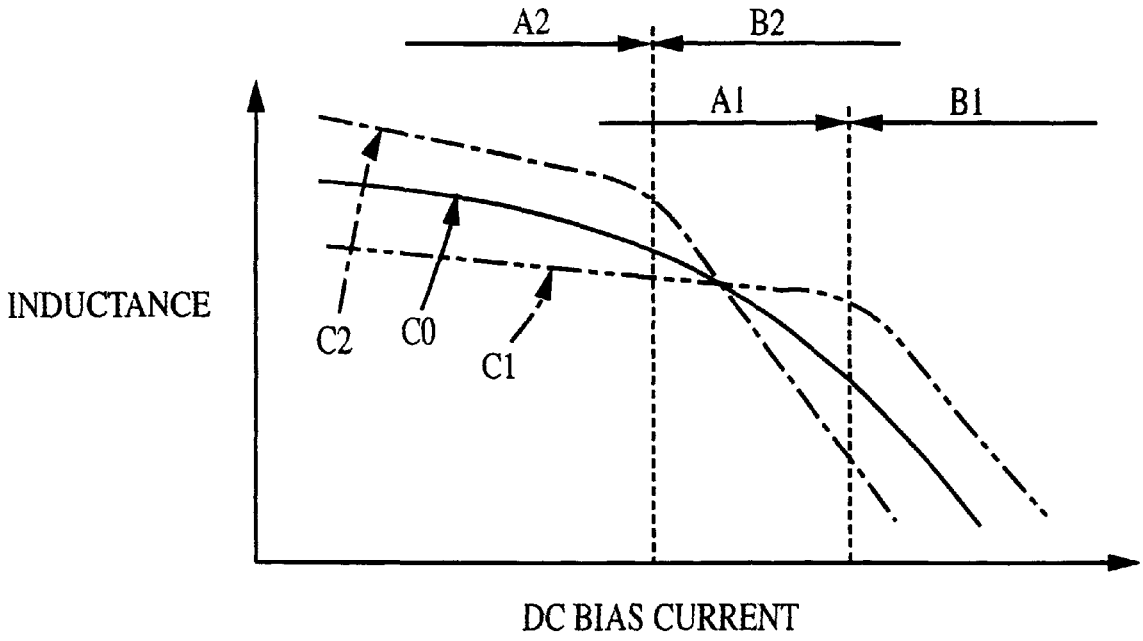
FIG. 8 is a schematic description of the inductance versus DC bias current for different magnetic spacer materials.

If the core 11 in FIG. 1 exhibits an inductance versus DC bias current characteristic of "C1" in FIG. 8 where A1 and B1 correspond to an active and inactive regions, respectively and the core insert material 31 or 32 in FIG. 5 exhibits the bias characteristic of "C2", a resultant bias characteristic of "CO" results, when the material corresponding to "C1" is used as core 11 and the material corresponding to "C2" is used as a spacer "31" or "32" in FIG. 6.

Figure 9:
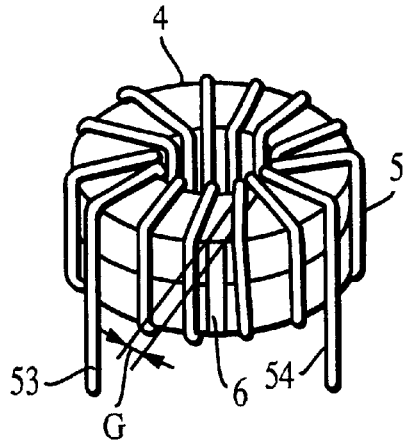
FIG. 9 represents a yet another core-coil assembly of the present invention.
Figure 10:
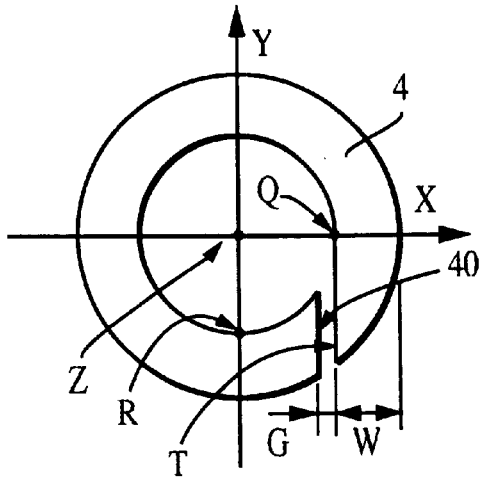
FIG. 10 indicates the physical configuration of the core assembly of the core-coil assembly of FIG. 9.
Figure 11:
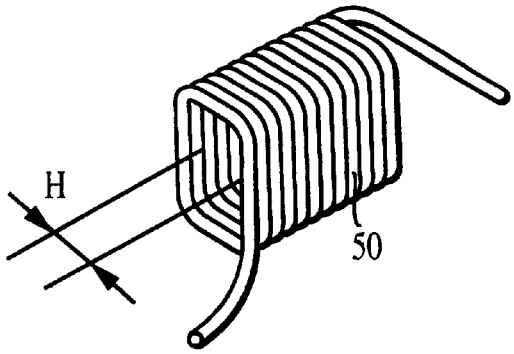
FIG. 11 shows a prefabricated coil configuration for the core-coil assembly of FIG. 9.
Figure 12A:
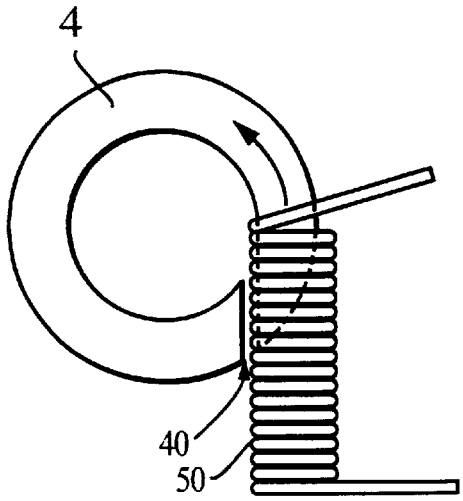
FIG. 12 shows a process of fabricating a core-coil assembly of FIG. 9 using a prefabricated coil.
Figure 12B:
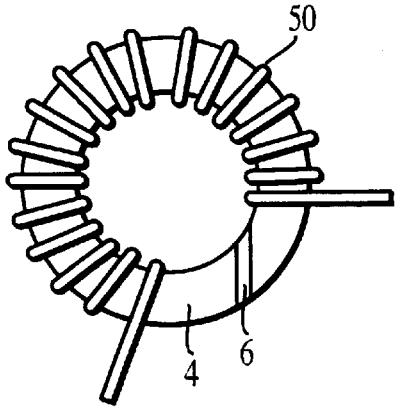
Figure 12C:
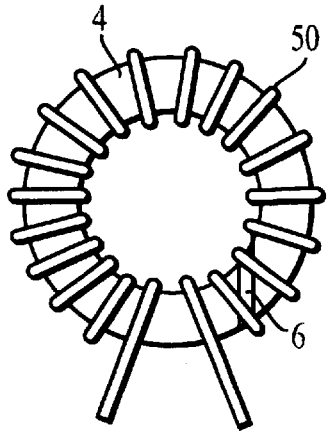

In accordance with the present invention, yet another method of fabricating a core-coil assembly is provided. An example of the core-coil assembly is shown in FIG. 9, where item 6 is a spacer with a width G, item 4 is a core assembly and 5 represents copper winding with two leads 53 and 54. FIG. 10 is a top view of a core assembly 4, where Z is the center of the toroidal core axis. The major difference between this core configuration and the one depicted in FIGS. 1–6 is the position of gap 40, the center of which is displaced from "Y" axis (X=0) up to X=ZQ−G/2, where ZQ is the distance between Z and the one end of the gap as indicated in FIG. 10. As shown in FIG. 10, when ZQ=ZR where ZR is the inner diameter of the core assembly, the plane QT is tangential to the inner circle of the core assembly. FIG. 11 shows a prefabricated coil 50 whose inner dimension is such that the core assembly can be inserted into this coil. For example, the distance H in FIG. 11 should be slightly larger than the core assembly width W in FIG. 10. FIG. 12*a* shows how a prefabricated coil 50 is fitted through a gap 40 into a core assembly of FIG. 10. When the coil 50 is placed on the core assembly 4, a spacer 6 may be inserted into gap 40 as shown in FIG. 12*b* and the coil configuration may be modified to have a uniform distribution of copper windings on the core assembly as shown in FIG. 12*c*. The coil in FIG. 11 and 12 has a rectangular shape, but a cylinder-shaped coil may be used for the same purpose. The spacer 6 of FIG. 9 may be of a magnetic or non-magnetic material as in FIG. 5. When spacer 6 is electrically conductive, its surface may be covered with a layer of insulating tape or insulating coating. Thus the above process results in a core-coil assembly of FIG. 9 with leads 53 and 54.

The advantages of the above core-coil assembly include separate fabrication of core assembly and copper coil, each process being fully or semi-automated using simple and inexpensive equipment. In addition, due to increased surface area in the gapped regions of the magnetic core, gap width 0 in FIG. 10 can be increased from the gap width of a core of FIG. 31 with the same physical dimension as that of FIG. 10, maintaining the same overall effective permeability. If the gap size is unchanged, on the other hand, effective permeability increases and core loss decreases when the core-coil assembly configuration of FIG. 9 is adopted over that of FIG. 1. The improved magnetic performance of the core configuration of FIG. 10 is also achieved in a core-coil assembly in which the outer core box does not have a gap, which corresponds to the case where an automatic coil winding is not an issue.

Figure 13A:
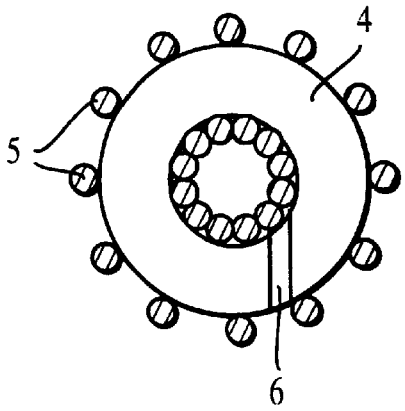
FIG. 13 shows a case where the cross-section of the copper wire of the core-coil assembly of FIG. 9 is round.
Figure 13B:
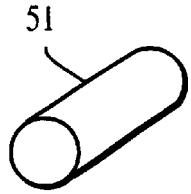
Figure 14A:
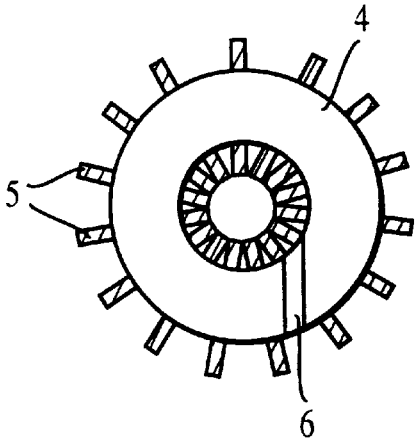
FIG. 14 shows a chase where the cross-section of the copper wire of the core-coil assembly of FIG. 9 is rectangular.
Figure 14B:
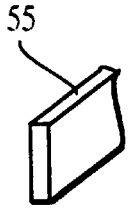
Figure 15A:
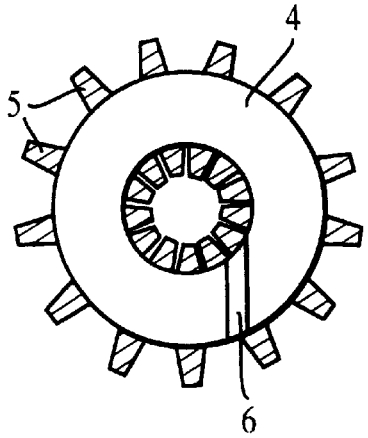
FIG. 15 shows a chase where the cross-section of the copper wire of the core-coil assembly of FIG. 9 is trapezoidal.
Figure 15B:
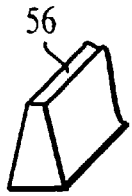

In accordance with the present invention which provides a means of automated coil winding processes for magnetic cores, the prefabricated coil 50 of FIG. 12*a* is not only a wire with circular cross-section 51 of FIG. 13*b* which results in a core-coil assembly with a top view of FIG. 13*a* where gap 6, coil 5 and core assembly 4 are indicated, but also a wire with a rectangular cross-section 55 of FIG. 14*b* which results in a core-coil assembly of FIG. 14*a* and a wire with a trapezoidal cross-section 56 of FIG. 15*b* resulting in a core-coil assembly of FIG. 15*a*. The core-coil assembly of FIG. 15*a* helps to increase the cross-section of the copper wire, resulting in an increased packing area for electrical conduction, which in turn reduces the size of the core-coil assembly and inter-winding capacitance. Furthermore, the coil configuration of FIG. 15*a* makes it easier to form a prefabricated coil 50 of FIG. 12 because of the geometry of the coil's cross-section shown in FIG. 15*b*.

Figure 16:
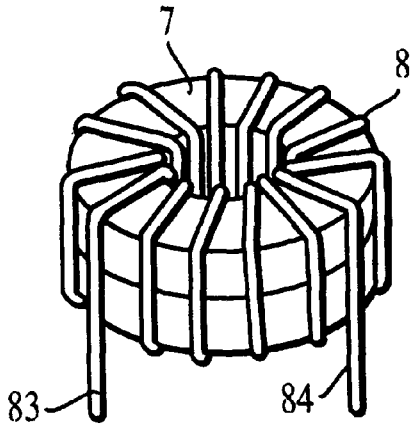
FIG. 16 shows a prior-art core-coil assembly.
Figure 17:
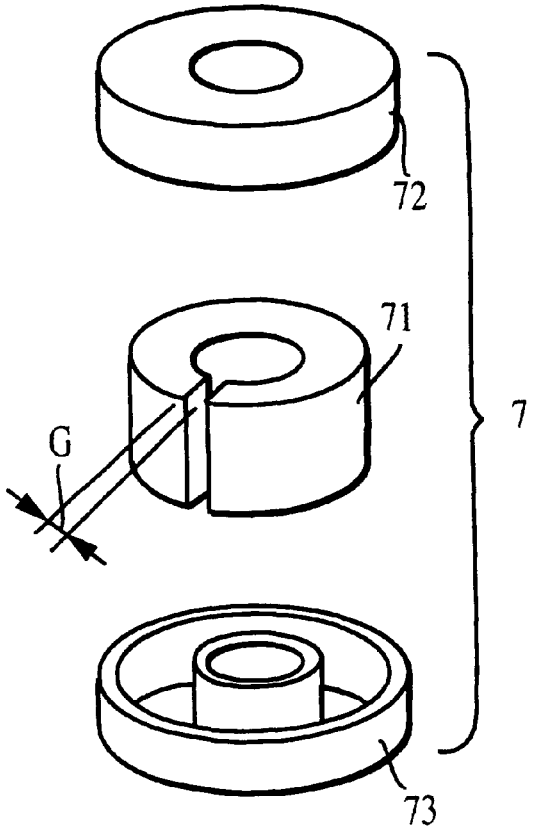
FIG. 17 shows a core assembly of a prior art.
Figure 18A:
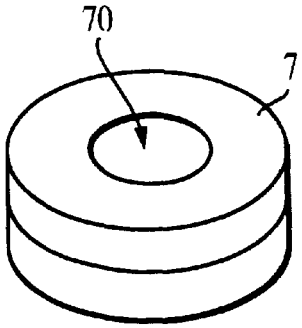
FIG. 18 depicts a prior-art process of winding a copper coil.
Figure 18B:
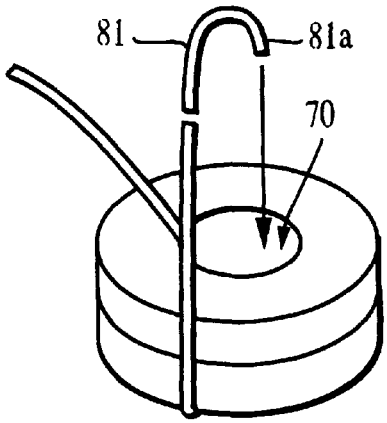
Figure 18C:
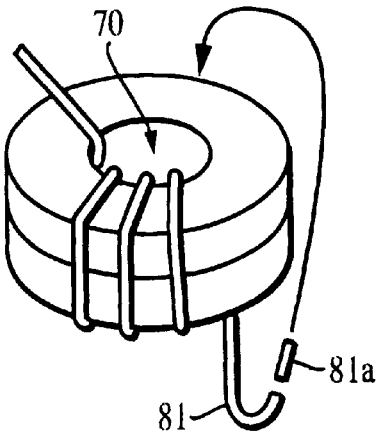

To demonstrate the difference between the present invention and the prior art, FIGS. 16–18 are provided. FIG. 16 represents a core-coil assembly of a prior art, where core assembly 7 has a copper winding 8 with electrical leads 83 and 84. FIG. 17 shows a magnetic core 71 with a gap G and the two halves 72 and 73 of an insulating box. FIG. 18*a* depicts a core assembly 7 which has a hole 70 in the middle of the toroidally-shaped core assembly. FIG. 18*b* shows the beginning of a coil winding process where a copper wire 81 with its end 81*a* is fed through the hole 70 of a core assembly of FIG. 18*a*. Subsequent copper winding is performed as shown in FIG. 18*c*. The copper winding process represented in FIGS. 18*b*–*c* requires a mechanical process akin to that of a sewing machine.

EXAMPLES

1. Sample Preparation

Magnetic cores were prepared by consolidating magnetic powder or winding a magnetic-metal ribbon onto a mandrel. When necessary, the cores were then heat-treated to achieve required magnetic properties. The cores were cut by an abrasive cutting tool or by a water jet to introduce a gap. Copper windings were applied on each core for magnetic measurements.

2. Magnetic Measurements

The inductance of a core-coil assembly was measured by a commercially available inductance bridge and the core's magnetic core loss was measured by the method described in the IEEE Standard 393–1991.

3. Magnetic Properties of Core-Coil Assemblies

Figure 19:
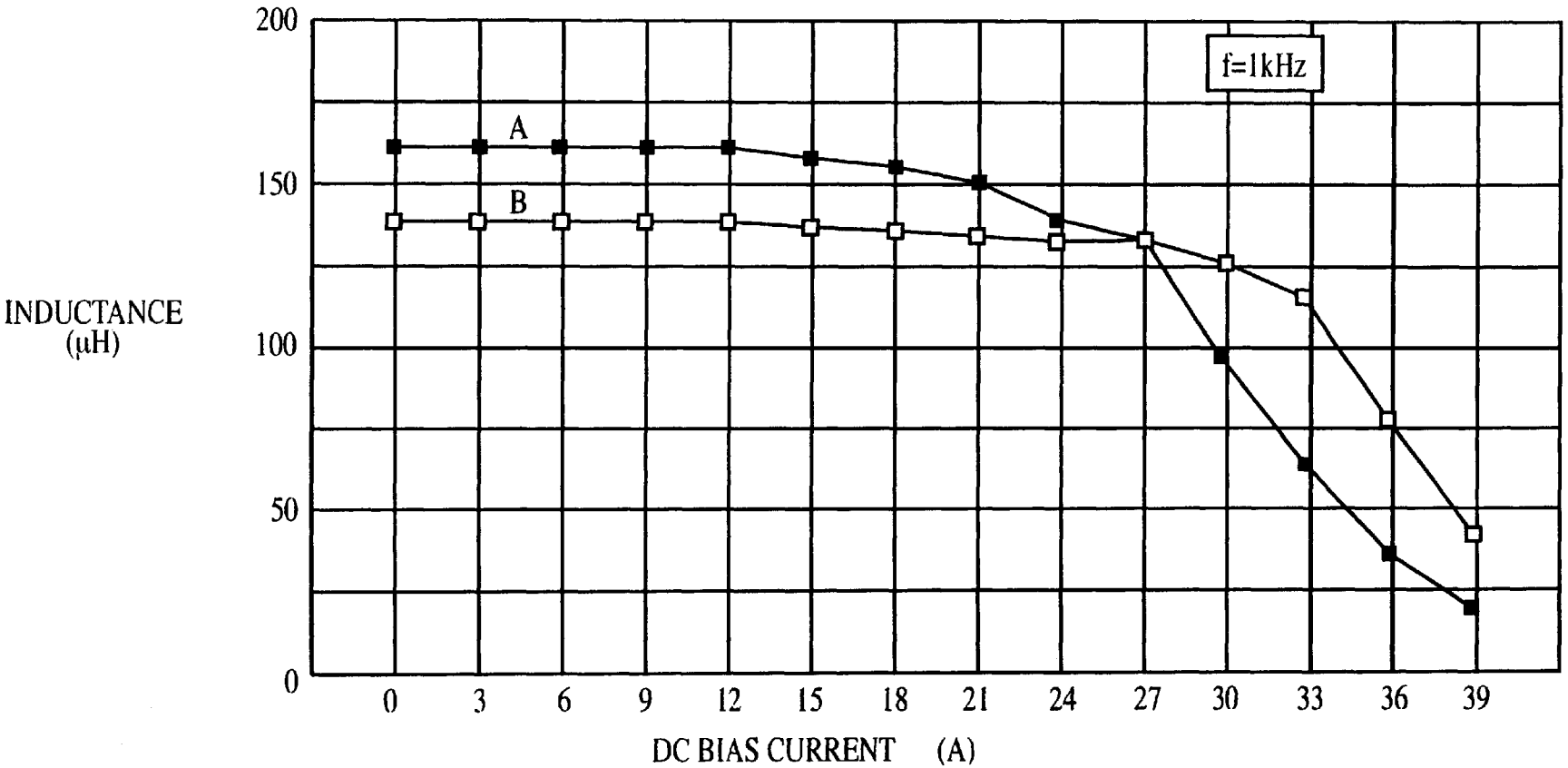
FIG. 19 shows inductance at 1 kHz versus DC bias current characteristics of the core-coil assemblies of the present invention, where curve A and B correspond to the core-coil assemblies of FIGS. 9 and 1, respectively, having a gap size of 1 mm.

Core-coils assemblies in accordance with the present invention were evaluated. FIG. 19 compares the inductance measured at 1 kHz as a function of bias current for two types of core-coil assemblies, one with the configuration of FIG. 9 which resulted in curve A and the other corresponding to FIG. 1 which resulted in curve B. The size of the cores for both cases was 22 mm×15 mm×15 mm for outside diameter, inside diameter and core height, respectively. The gap G was 1 mm for both cases. The core material was iron powder. The core-coil configuration of FIG. 9 exhibited a higher inductance than that of FIG. 1 at lower bias current, the tendency of which was reversed at higher bias current levels. In light of the cases depicted in FIG. 7, this indicates that the gap size G can be increased without affecting the inductance versus bias current characteristics when the core assembly configuration of FIG. 9 is adopted over that of FIG. 1. The increased gap size makes the core-coil assembly process of FIG. 12 easier. If a higher permeability is desired at lower DC bias region, the core-coil assembly of FIG. 9 may be adopted over that of FIG. 1 without reducing the gap size.

Figure 20:
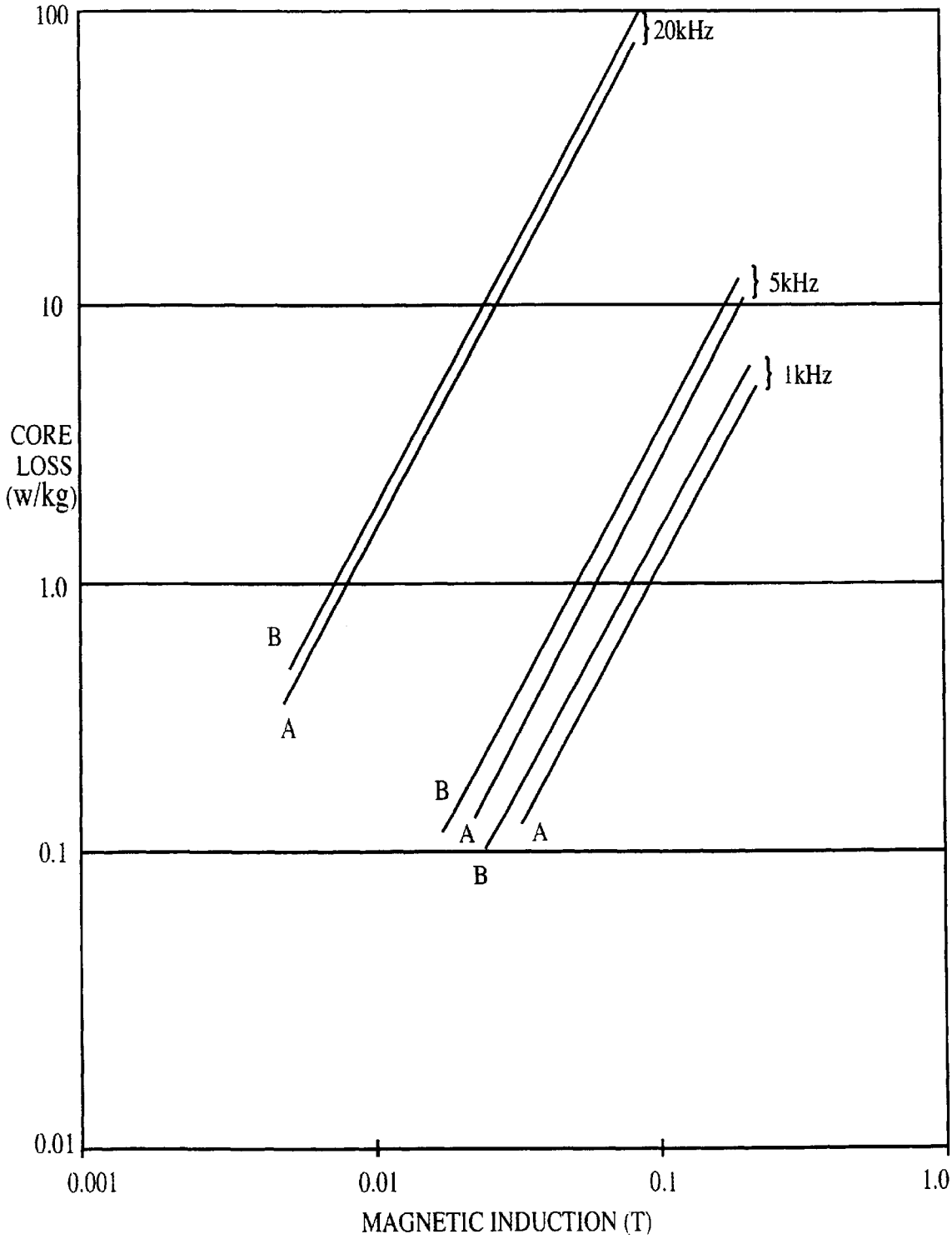
FIG. 20 shows core loss at different frequencies as a function of magnetic induction for the core-coil assemblies of the present invention, where curve A and B correspond to the core-coil assemblies of FIGS. 9 and 1, respectively, having a gap size of 1 mm.

The core losses of the two types of cores of FIG. 19 were measured at different frequencies as a function of magnetic induction, which are shown in FIG. 20. It is clear that core loss at any given frequency is lower for the core-coil configuration of FIG. 9 corresponding to curves A than that of FIG. 1 corresponding to curves B, both of which have the same gap size.

Having thus described the invention rather fully in detail, it will be understood that this detail needs not be strictly adhered to but that further changes and modifications may suggest themselves to one skilled in the art all falling within the scope of the invention as defined by the subjoined claims.

What is claimed is:

1. A core-coil assembly comprising: a gapped magnetic core having a periphery, an inner radius and a single gap, the gap extending through a portion of the magnetic core in a direction tangential to the inner radius of the magnetic core, and wire windings wound about the magnetic core.

2. A core-coil assembly according to claim 1 which further comprises a spacer inserted in said gap.

3. The core-coil assembly according to claim 2 wherein the spacer is formed of a magnetic material.

4. The core-coil assembly according to claim 2 wherein the spacer is formed of a non-magnetic material.

5. The core-coil assembly according to claim 1 wherein the wire windings have a cross-sectional shape selected from: round, rectangular and trapezoidal.

6. The core-coil assembly of claim 1 which further comprises an insulating layer accommodating the magnetic core and the spacer.

7. The core-coil assembly of claim 6 wherein the insulating layer is selected from from: a core box, a polymer resin layer, and an electrically insulating paint layer.

8. The core-coil assembly according to claim 1 wherein the magnetic core comprises a material selected from: amorphous alloys, partially crystallized amorphous alloys, nanocrystalline alloys, crystalline alloys, metals, and sintered magnetic powders.

* * * * *